US008104732B1

(12) United States Patent
Robinson et al.

(10) Patent No.: US 8,104,732 B1
(45) Date of Patent: Jan. 31, 2012

(54) MAILBOX MOUNTING BRACKET ASSEMBLY

(75) Inventors: Larry D. Robinson, Taylorsville, MS (US); J. Derrick Dry, Laurel, MS (US)

(73) Assignee: Solar Group, Inc., Taylorsville, MS (US)

( * ) Notice: Subject to any disclaimer, the term of this patent is extended or adjusted under 35 U.S.C. 154(b) by 268 days.

(21) Appl. No.: 12/505,572

(22) Filed: Jul. 20, 2009

(51) Int. Cl.
*A47B 91/00* (2006.01)

(52) U.S. Cl. ..... 248/346.01; 232/39; 248/288.11; 248/298.1; 248/300; 248/346.03; 248/346.06

(58) Field of Classification Search ..... 248/298.1, 248/297.51, 346.07, 346.06, 346.5, 346.01, 248/274.1, 288.1, 288.11; 232/39
See application file for complete search history.

(56) References Cited

U.S. PATENT DOCUMENTS

| | | | | |
|---|---|---|---|---|
| 3,990,629 | A | 11/1976 | Hodge | |
| 4,874,099 | A * | 10/1989 | Arnott et al. | 211/50 |
| 4,951,905 | A | 8/1990 | Bronson et al. | |
| 5,263,668 | A * | 11/1993 | Reiter | 248/346.01 |
| 5,337,954 | A | 8/1994 | Kobilarcik et al. | |
| 5,397,081 | A * | 3/1995 | Landry et al. | 248/346.5 |
| 6,543,680 | B1 * | 4/2003 | McCormack | 232/39 |
| 6,805,327 | B1 * | 10/2004 | Shen | 248/346.07 |
| 7,438,214 | B2 | 10/2008 | Riker et al. | |

* cited by examiner

*Primary Examiner* — Amy J Sterling
(74) *Attorney, Agent, or Firm* — Eckert Seamans Cherin & Mellott, LLC; David C. Jenkins, Esquire

(57) ABSTRACT

A mailbox mounting bracket is provided wherein there are two substantially identical bracket members that are coupled together to form the mailbox mounting bracket. The two bracket members may be adjusted in a lateral direction to have a width corresponding to any typical mailbox size.

12 Claims, 9 Drawing Sheets

MAILBOX MOUNTING BRACKET ASSEMBLY

BACKGROUND OF THE INVENTION

1. Field of the Invention

This concept relates to a mailbox mounting bracket and, more specifically, to a mailbox mounting bracket structured to be adjustable to fit mailboxes having different widths while also being structured to be stored in a minimal space.

2. Background Information

Freestanding mailboxes, typically found in rural or suburban areas, must be located immediately adjacent to a road so that a delivery person may access the mailbox while remaining in their vehicle. Such mailboxes are typically disposed on a post which is either a simple vertical post, or, a vertical post having a horizontal arm. Mailboxes, which are subject to government design regulations, are generally elongated boxes having an interior with a flat bottom, two vertical longitudinal sidewalls, a vertical back sidewall, and a door on the front sidewall. The top of the mailbox may be flat or generally arcuate. The bottom edge of each side of the mailbox typically forms a flange that extends beyond the planar member that forms the interior bottom surface of the mailbox. Thus, the external bottom surface of the mailbox forms a cavity or socket. As typical posts, e.g. a 4×4 post, used to support mailboxes are smaller than the size of the mailbox lower cavity, mailbox mounting brackets are used to securely couple a mailbox to a post. A mailbox mounting bracket is structured to extend the entire width of the mailbox lower cavity as well as providing an attachment to the supporting post.

Mailbox mounting brackets are typically plastic or sheet metal and, as such, are inexpensive items with minimal profit margins. Thus, any improvement that reduces the manufacturing cost of the mailbox bracket is desirable. Most manufacturers produce specific mailbox brackets for each common size mailbox, e.g. small, medium and large. Thus, most manufacturers must have molds for, and produce, each size of mailbox mounting bracket. Further, when such mailbox mounting brackets are made as a single piece, the storage/shipping/display boxes must be at least the size of the mailbox mounting bracket.

SUMMARY OF THE INVENTION

The disclosed and claimed concept improves upon known mailbox mounting brackets designs by providing a mailbox bracket assembly that is bifurcated having two substantially identical parts that are coupled together to form the mailbox mounting bracket. Moreover, the two parts of the mailbox mounting bracket may be adjusted to have a width corresponding to each typical mailbox size. Thus, rather than producing multiple different size mailbox mounting brackets, only a single size component is needed. Further, the single size component is structured with a corresponding component, that is, mirrored shape, so that the two components may be stored/shipped/displayed in a reduced space. The smaller, preassembled configuration also allows for the packaging to have a reduced size, thereby reducing costs even further.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENTS

As used herein, a "bi-level base plate" is a plate having two planar portions that extend in generally parallel, but different, planes.

As used herein, "depending" means to extend from the edge of, or extend adjacent to the edge of, another element without regard to direction.

As used herein, "coupled" means a link between two or more elements, whether direct or indirect, so long as a link occurs.

As used herein, "directly coupled" means that two elements are directly in contact with each other.

As used herein, "fixedly coupled" or "fixed" means that two components are coupled so as to move as one while maintaining a constant orientation relative to each other.

As used herein, the word "unitary" means a component is created as a single piece or unit. That is, a component that includes pieces that are created separately and then coupled together as a unit is not a "unitary" component or body.

It is noted that the United States Government formerly had specific regulations governing the size of mailboxes; the current regulations are not as specific. As used herein, a mailbox size indication shall correspond, generally, to the former regulations. That is, a "small" mailbox means a mailbox with a width of about six inches, a "medium" mailbox means a mailbox with a width of about eight inches, a "large" mailbox means a mailbox with a width of about ten inches, and an "extra large" mailbox means a mailbox with a width of about twelve inches.

As used herein, a "four by four" (which measures 3.5 inches by 3.5 inches) may be made of wood, plastic, or composite materials. The four by four may be solid, e.g. a typical wood post, or hollow, such as an extruded post.

Figure 3:
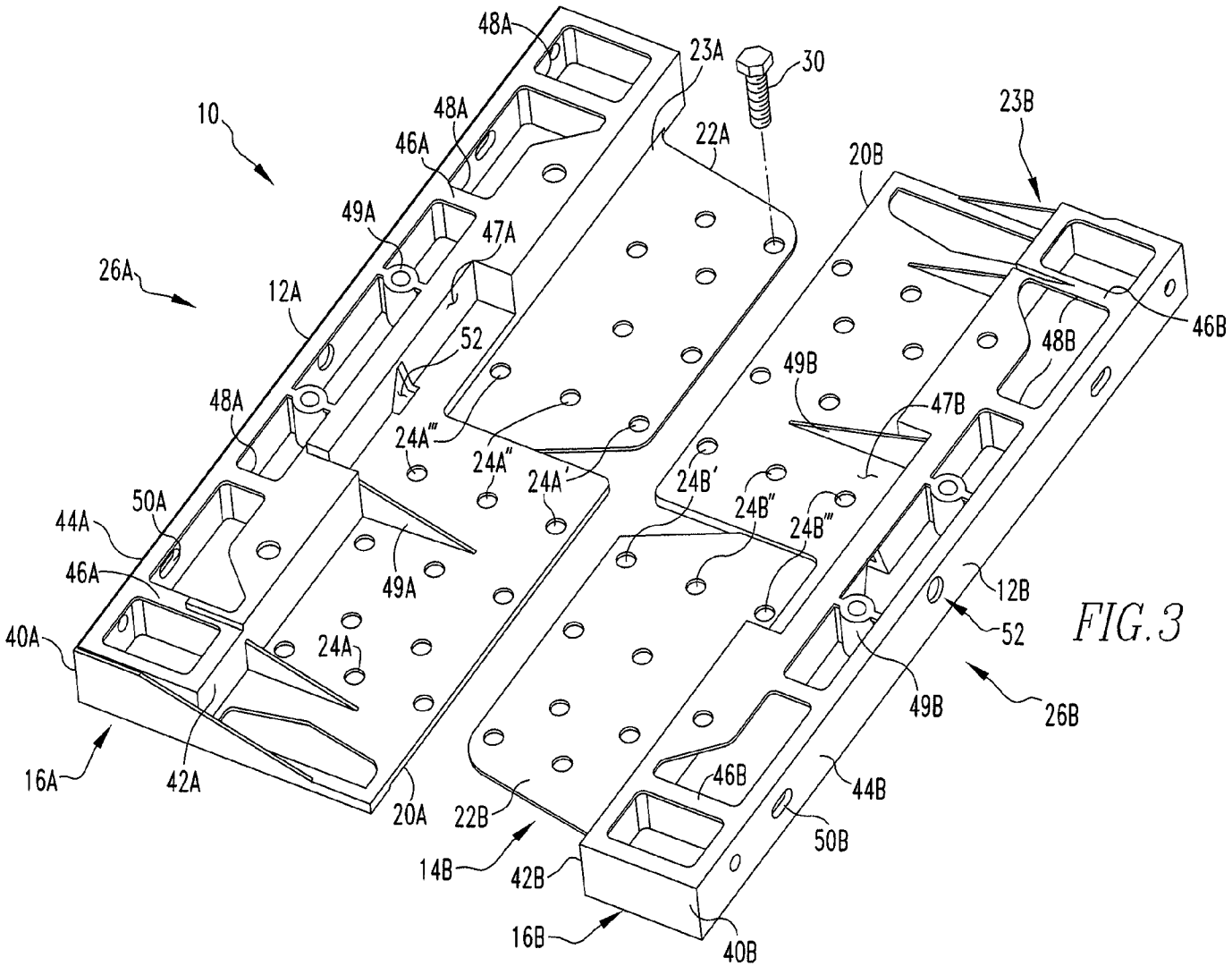
FIG. 3 is exploded isometric view of a mailbox bracket assembly.

As used herein, directional terms, such as, but not limited to, "front," "back," "right," "left," "upper," "lower," and correspond to the orientation of the bracket assembly, or bracket member, as shown in the Figures. It is noted that the bracket assembly may be used in any orientation and that the bracket assembly is specifically designed to be used, depending upon the post to which it is attached, with either longitudinal face being the "upper" face. As such, directional terms are not limiting upon the claims. Further, in a preferred embodiment, as shown in FIG. 3, the mailbox bracket assembly 10, discussed below, is generally elongated and therefore has a longitudinal axis. Thus, as used herein, a "lateral edge" is an edge that extends parallel to, but spaced from the longitudinal axis.

As used herein, to extend "laterally" means to extend generally perpendicular to the longitudinal axis of the mailbox bracket assembly 10. Generally, as used herein, "inner" means closer to the longitudinal axis of the mailbox bracket assembly 10 and "outer" means further from the longitudinal axis of the mailbox bracket assembly 10. It is noted that, in a less preferred embodiment, the mailbox bracket assembly 10 could have a generally square shape, or be elongated in a direction lateral to a mailbox's longitudinal axis. Regardless of the shape of the mailbox bracket assembly 10, the words defined in this paragraph shall maintain their meaning as described relative to the preferred embodiment. That is, for example, the "lateral edge" of the mailbox bracket assembly 10 is that edge which engages, or extends parallel to, the lateral edge of an elongated mailbox.

Figure 1:
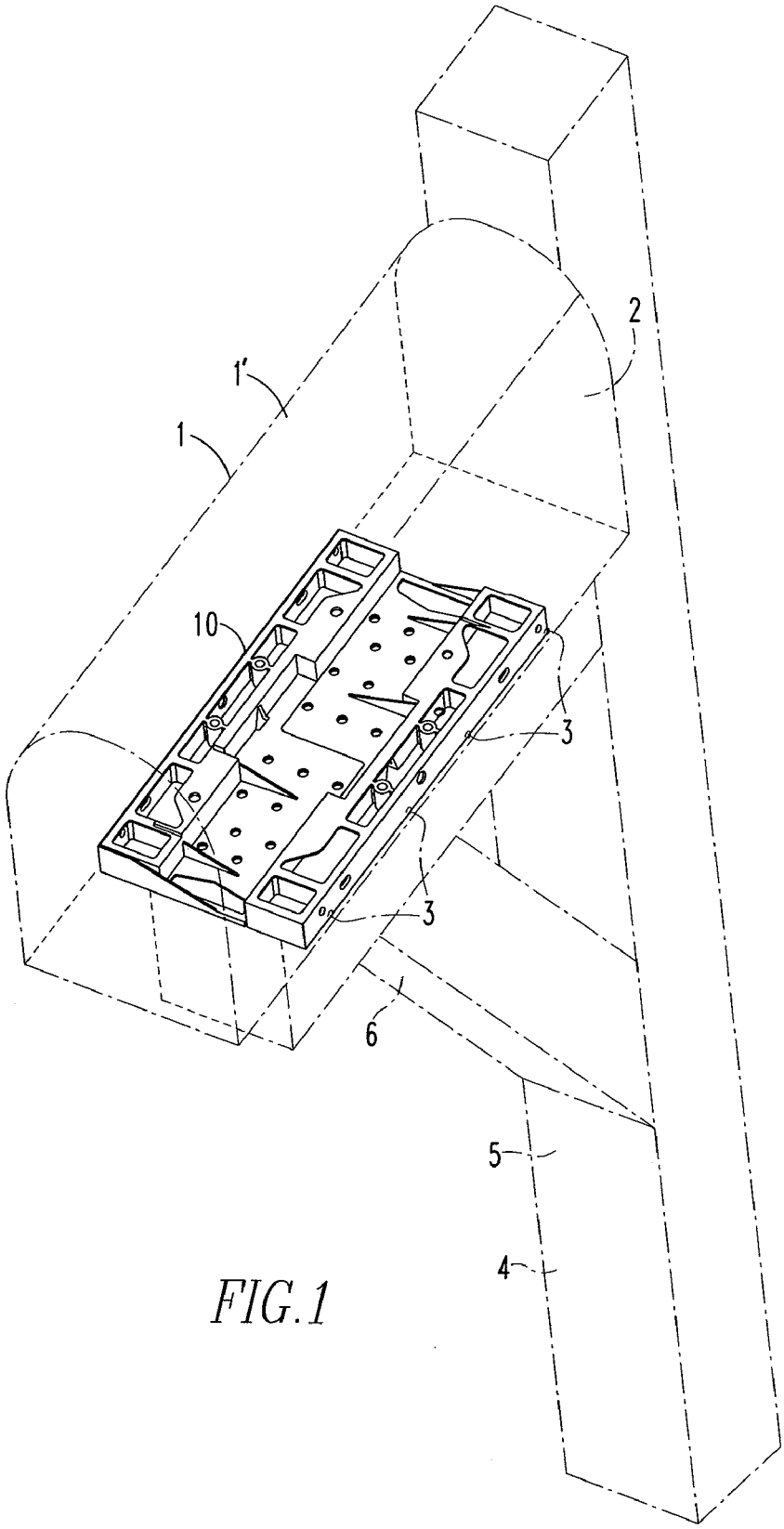
FIG. 1 is an isometric view of a mailbox on a support structure.
Figure 2:
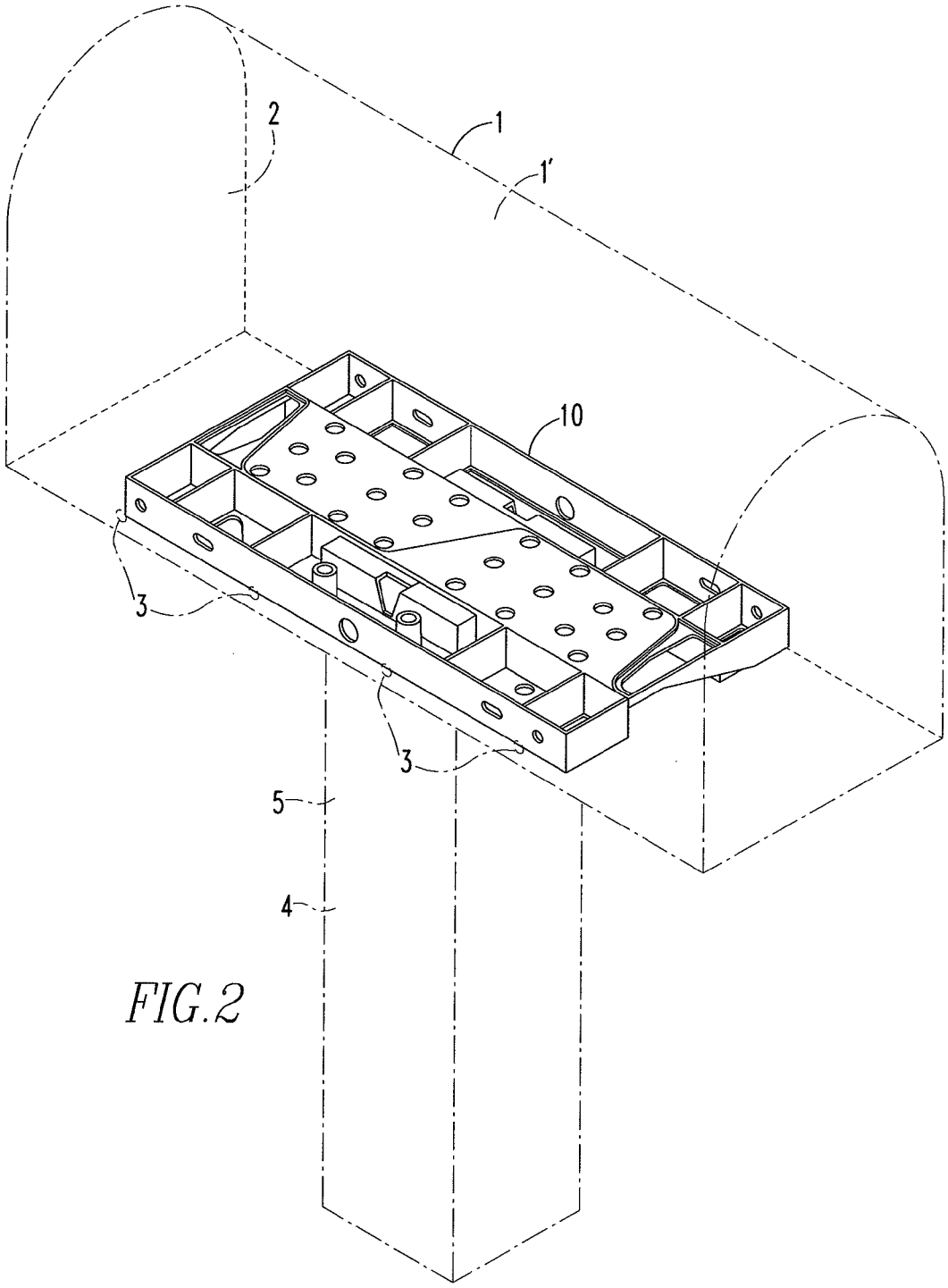
FIG. 2 is an isometric view of a mailbox on an alternate support structure.

As shown in FIG. 1, a mailbox 1 includes a bottom member, a back wall, a movable front door, and a pair of generally vertical sidewalls. The generally vertical sidewalls are typically contiguous with an arcuate top member (as shown) or a flat top member (not shown). The bottom edge of each sidewall of the mailbox typically forms a flange that extends beyond the planar bottom member. Thus, the external bottom surface of the mailbox forms a cavity. About the lower edges of each sidewall are a plurality of openings 3 structure to allow a fastener, such as, but not limited to, a bolt or screw, pass therethrough. The mailbox 1 is structured to be coupled to a support structure 4. The support structure 4 typically includes a generally vertical post 5 and/or a generally horizontal arm 6. The mailbox 1 may be coupled to either the horizontal arm 6, as shown in FIG. 1, or, the mailbox 1 may be coupled to the vertical post 5, as shown in FIG. 2. The mailbox 1 is coupled to the support structure 4 by a mailbox bracket assembly 10.

As shown in FIG. 3, a mailbox bracket assembly 10 has a first member 12A and a second member 12B. As detailed below, the mailbox bracket assembly first and second members 12A, 12B are substantially similar. Accordingly, the following description shall address the components of only the first member 12A. It is understood that the second member 12B has similar components. The components of the first member 12A shall be identified by a reference number followed by the letter "A." Corresponding components of the second member 12B have the same reference number followed by the letter "B." For example, the first bracket member 12A has a bi-level base plate 14A and a depending lateral sidewall assembly 16A. It is understood that the second bracket member 12B has a bi-level base plate 14B and a depending lateral sidewall assembly 16B.

Figure 4:
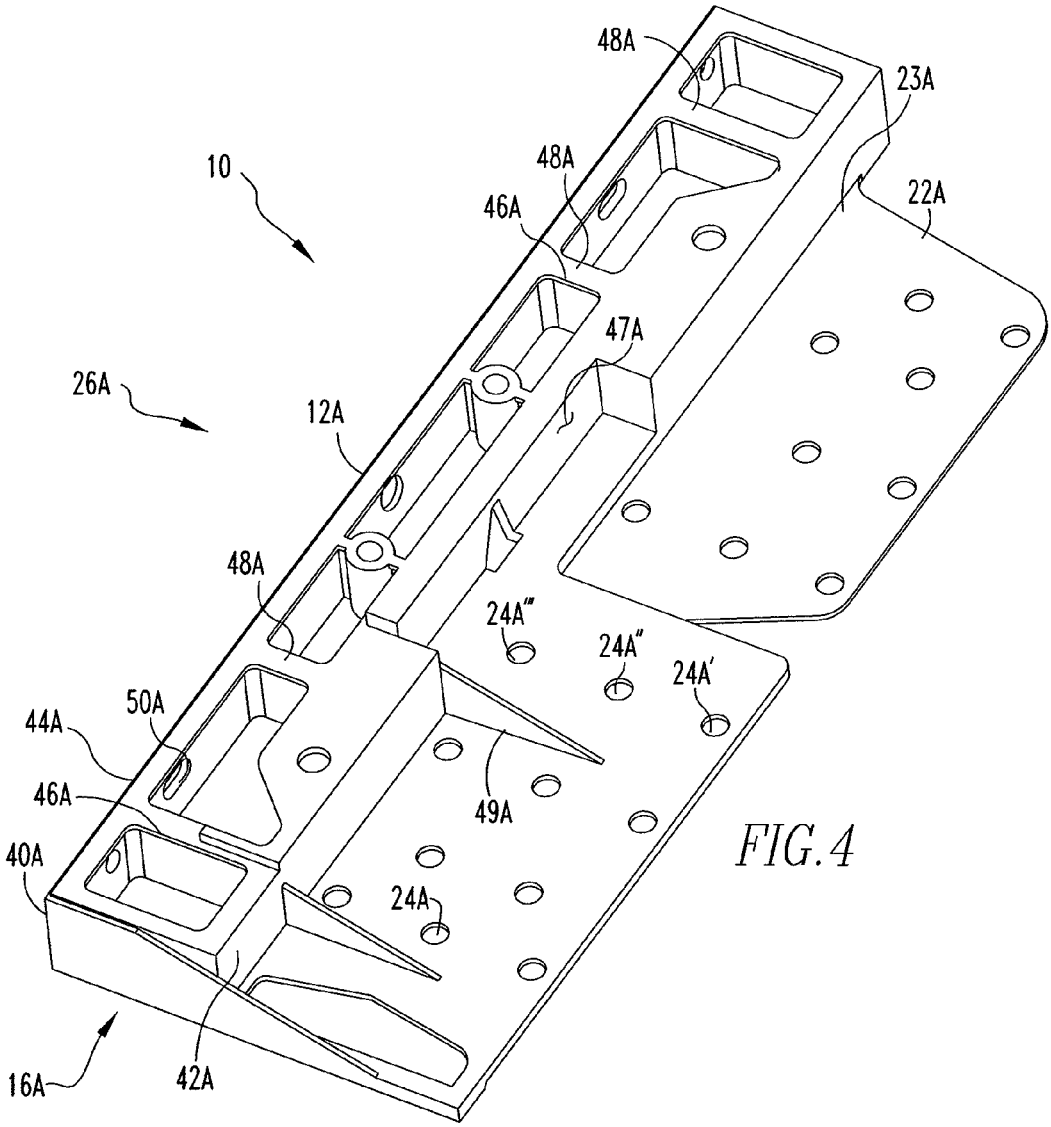
FIG. 4 is an isometric view of a single mailbox bracket assembly member.
Figure 5:
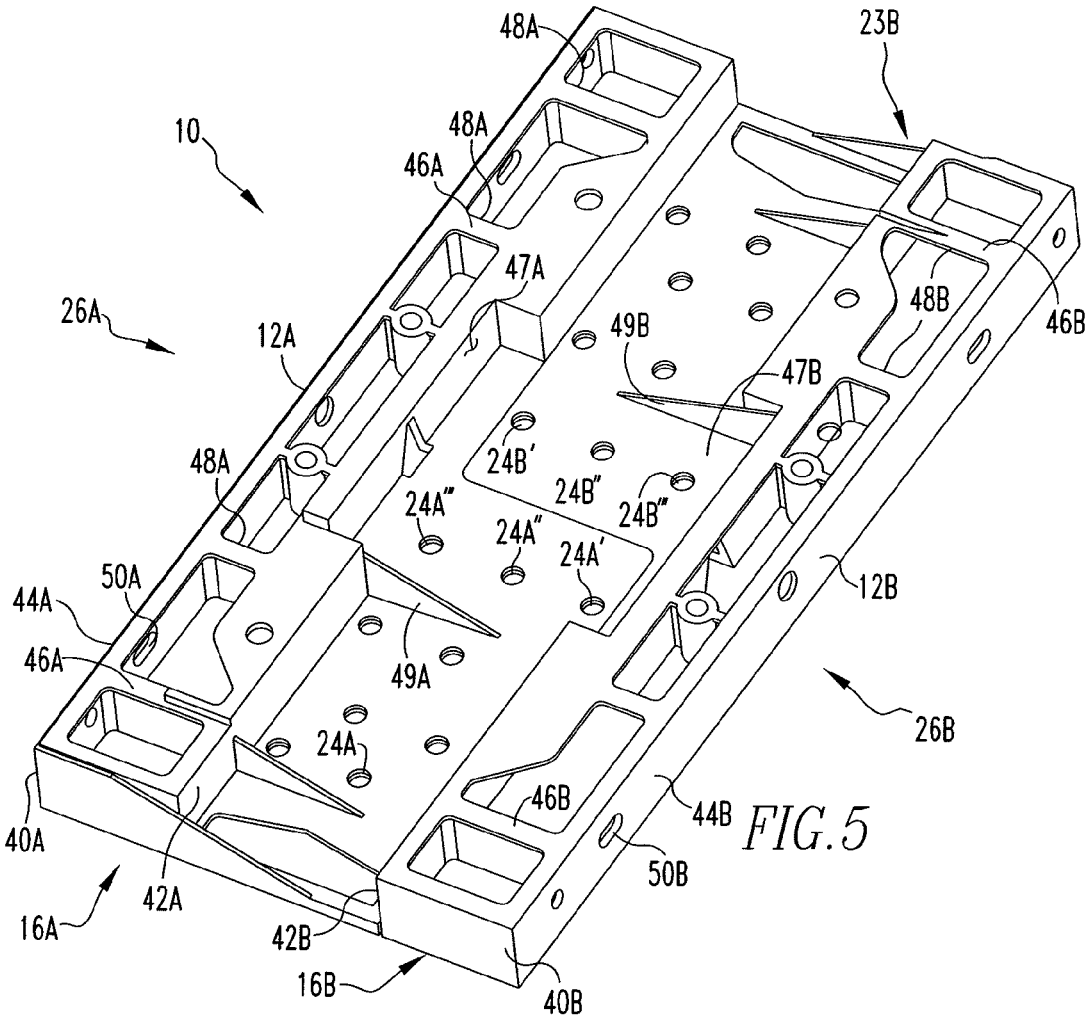
FIG. 5 is an isometric view of a mailbox bracket assembly in a first configuration.

As shown in FIG. 4, the first bracket member bi-level base plate 14A is, preferably, an elongated generally planar member having a first portion 20A and a second portion 22A. That is, the first bracket member bi-level base plate first portion 20A and first bracket member bi-level base plate second portion 22A are each generally planar members that extend in parallel, but offset, planes. The first bracket member bi-level base plate 14A has a generally straight outer edge 23A. The first bracket member bi-level base plate first portion 20A is, preferably, generally rectangular. The first bracket member bi-level base plate second portion 22A is, preferably, generally trapezoidal wherein the inner and outer edges are generally aligned with the first bracket member bi-level base plate first portion 20A. That is, the laterally extending edges of the first bracket member bi-level base plate second portion 22A may be angled. The first bracket member bi-level base plate first portion 20A and first bracket member bi-level base plate second portion 22A are offset from each other in a direction generally normal to the planes of the first bracket member bi-level base plate first portion 20A and first bracket member bi-level base plate second portion 22A. In this configuration, the first bracket member bi-level base plate 14A and the second bracket member bi-level base plate 14B are structured to engage each other in an interleaved manner, as shown in FIG. 5.

It is noted that in the configuration described above, and when assembled as described below, the interleaved bi-level base plate first portions 20A, 20B and bi-level base plate second portions 22A, 22B cooperate to form, essentially, a single base plate. To provide enhanced rigidity, it is desirable for the combined base plate to be substantially continuous along the longitudinal axis. That is, it is preferred that there not be a laterally extending gap between the interleaved bi-level base plate first portions 20A, 20B and/or bi-level base plate second portions 22A, 22B when the first and second members 12A, 12B are assembled. Similarly, it is preferable that at least one of either the first or second bi-level base plate portions 20A, 20B or 22A, 22B be rectangular and extend substantially close to half the longitudinal length of the first and second members 12A, 12B so that such a gap does not exist, or is very minimal. It is further noted that the trapezoidal shape of the bi-level base plate second portions 22A, 22B are structured to allow for easier assembly. That is, given that the bi-level base plate first portions 20A, 20B extend substantially close to half the longitudinal length of the first and second members 12A, 12B, there would be an increased chance of interference during assembly if the bi-level base plate second portions 22A, 22B had the same shape. It is further noted that, in a less preferred embodiment (not shown), both first and second bi-level base plate portions 20A, 20B, 22A, 22B could be trapezoidal. This, however, would likely cause an undesirable lateral gap near the middle of the assembled mailbox bracket assembly 10.

That is, the first bracket member bi-level base plate first portion 20A has a thickness and the first bracket member bi-level base plate second portion 22A has a thickness. Similarly, the second bracket member bi-level base plate first portion 20B has a thickness and the second bracket member bi-level base plate second portion 22B has a thickness. Preferably, the first bracket member bi-level base plate first portion 20A thickness and the second bracket member bi-level base plate first portion 20B thickness are substantially similar, and, the first bracket member bi-level base plate second portion 22A thickness and the second bracket member bi-level base plate second portion 22B thickness are substantially similar.

More preferably, the first bracket member bi-level base plate first portion 20A thickness, the first bracket member bi-level base plate second portion 22A thickness, the second bracket member bi-level base plate first portion 20B thickness and the second bracket member bi-level base plate second portion 22B thickness are all substantially similar. In this configuration, the distance that the first bracket member bi-level base plate first portion 20A and the first bracket member bi-level base plate second portion 22A are offset from each other is generally similar to the first bracket member bi-level base plate first portion 20A thickness and the first bracket member bi-level base plate second portion 22A thickness. Accordingly, the distance that the second bracket member bi-level base plate first portion 20B and the second bracket member bi-level base plate second portion 22B are offset from each other is generally similar to the second bracket member bi-level base plate first portion 20B thickness and the second bracket member bi-level base plate second portion 22B thickness. In the preferred configuration, the first bracket member bi-level base plate first portion 20A is structured to be interleaved with the second bracket member bi-level base plate second portion 22B, and, the first bracket member bi-level base plate second portion 22A is structured to be interleaved with the second bracket member bi-level base plate first portion 20B, as shown in FIG. 3.

The mailbox bracket assembly first and second members 12A, 12B are structured to be configured with various widths that correspond, generally, to known mailbox 1 sizes. That is, mailboxes 1, typically, have one of four widths; small, medium, large or extra large. The mailbox bracket assembly first and second members 12A, 12B are structured to be positioned laterally relative to each other so as to generally correspond to one of a small, medium, large or extra large mailbox 1 width, as described above. For example, the mailbox bracket assembly 10 may be configured to the width of a small mailbox 1, about six inches, by having the first and second members 12A, 12B positioned as closely together as possible, as shown in FIG. 5. In this configuration, the first bracket member bi-level base plate 14A is as close to the second bracket member sidewall assembly 16B as possible, preferably abutting the second bracket member sidewall assembly 16B. Similarly, the second bracket member bi-level base plate 14B is as close to the first bracket member sidewall assembly 16A as possible, preferably abutting the first bracket member sidewall assembly 16A.

Figure 6:
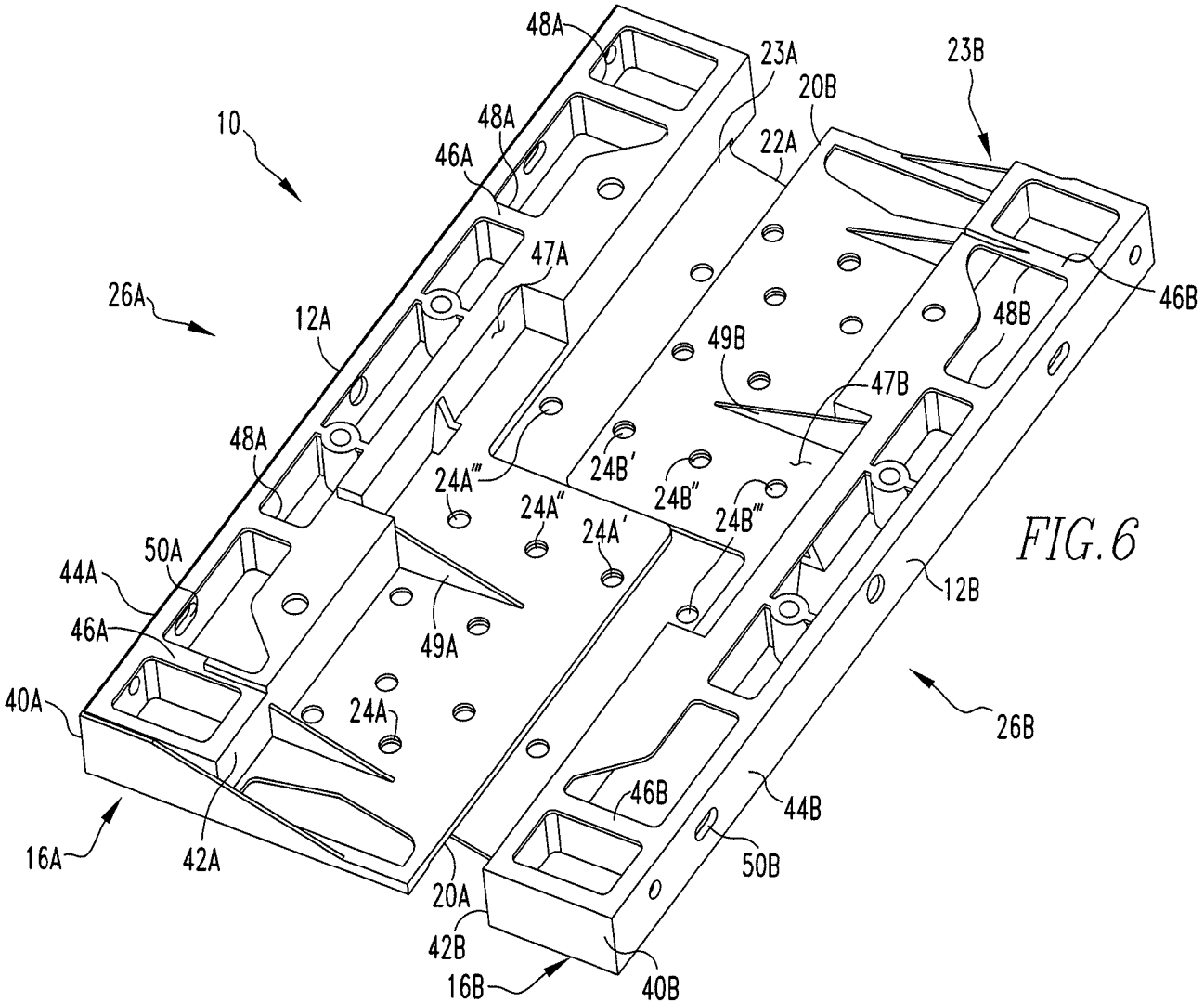
FIG. 6 is an isometric view of a mailbox bracket assembly in a second configuration.
Figure 7:
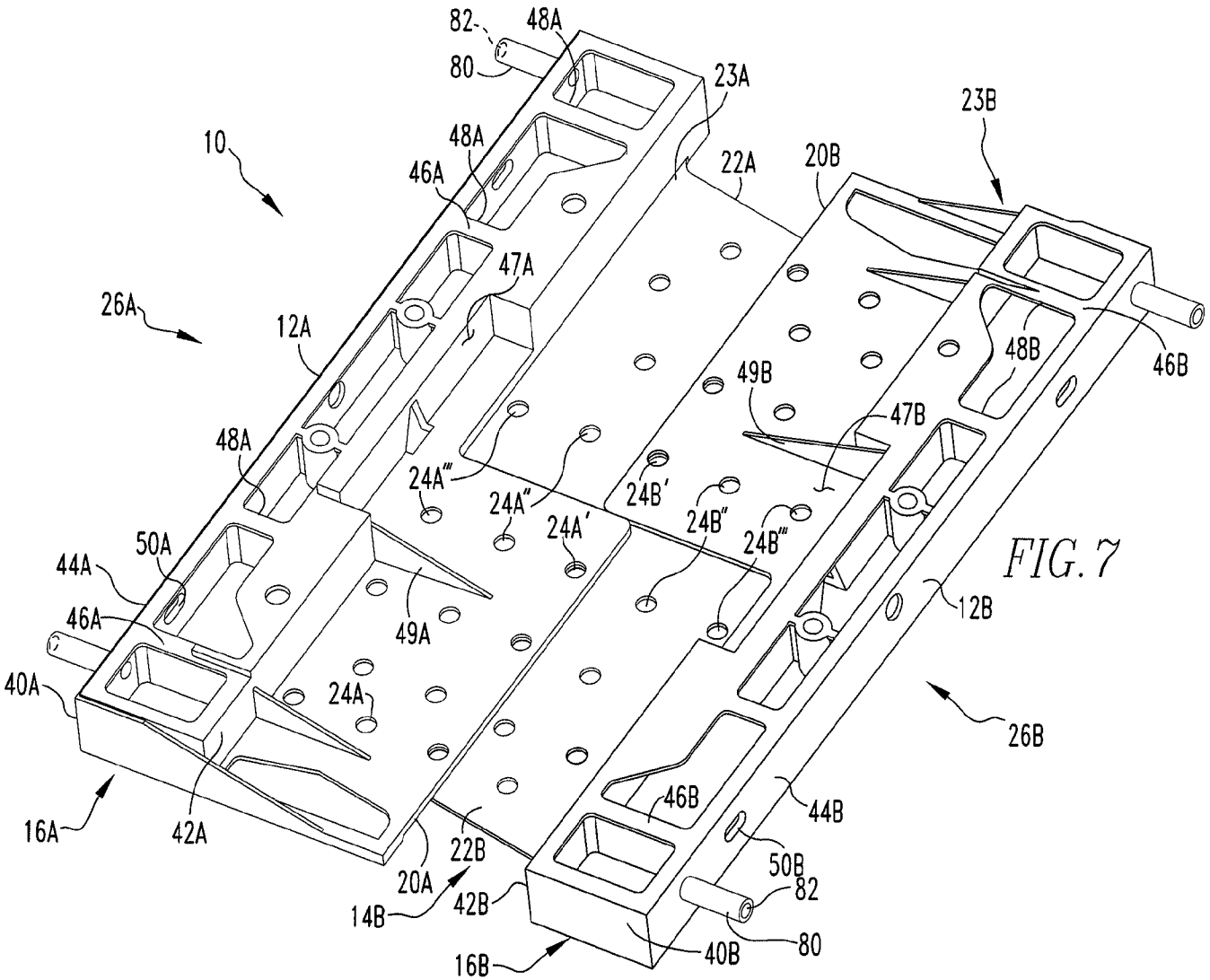
FIG. 7 is an isometric view of a mailbox bracket assembly in a third configuration.
Figure 8:
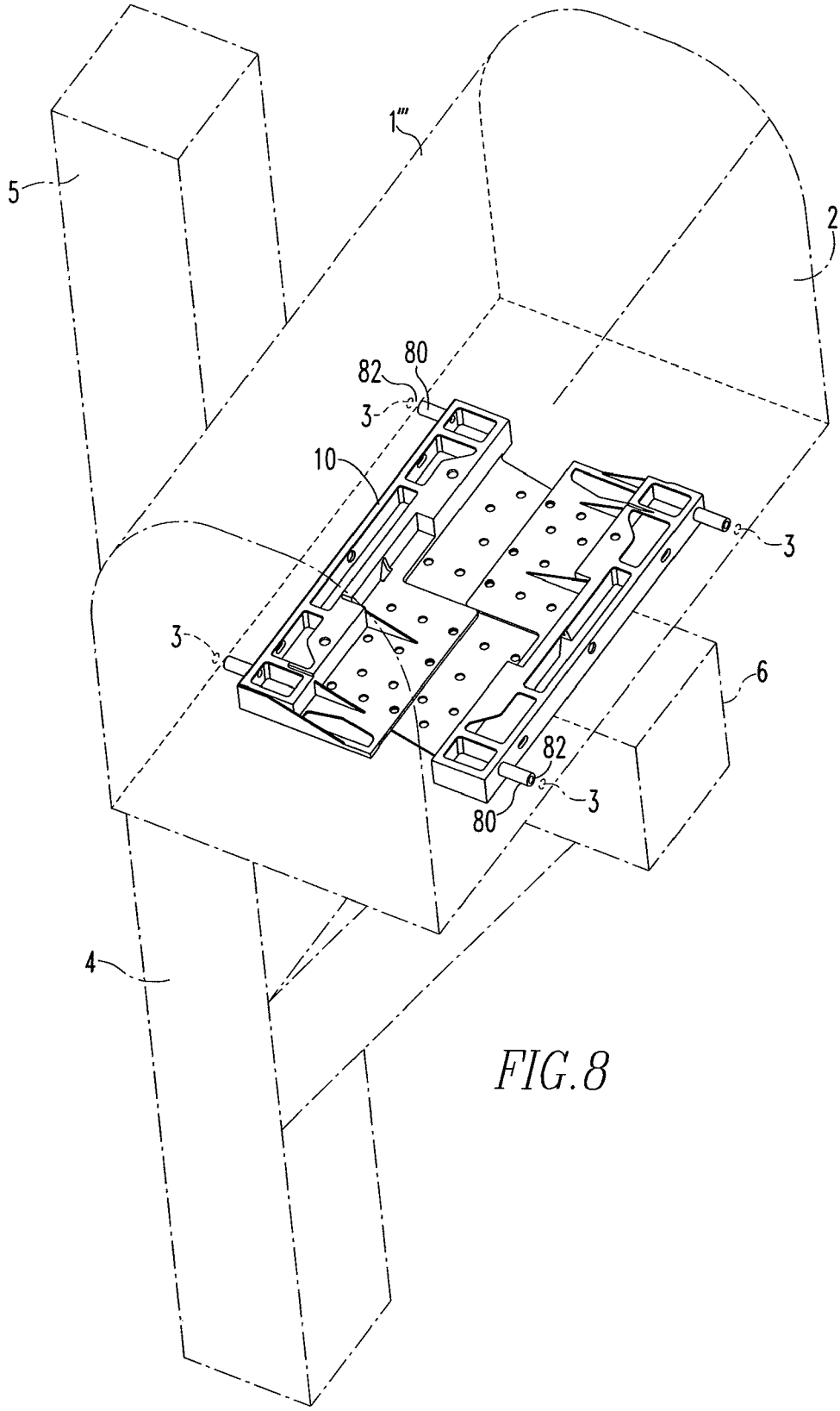
FIG. 8 is an isometric view of a mailbox on a support structure.

For a medium width mailbox 1', the first and second members 12A, 12B are moved, relative to the small width configuration described above, laterally away from each other a first distance, as shown in FIG. 6. For a large mailbox 1", the first and second members 12A, 12B are moved, relative to the small width configuration described above, laterally away from each other a second distance which is greater than the first distance, as shown in FIG. 7. To accommodate an extra large width mailbox 1''', as shown in FIG. 8, the first and second members 12A, 12B are positioned in a manner similar to the configuration for a large mailbox 1", but the mailbox bracket assembly 10 further includes at least one lateral extension 80, which is discussed in detail below.

As shown in FIGS. 3-5, the first bracket member bi-level base plate first portion 20A and the first bracket member bi-level base plate second portion 22A each have a plurality of openings 24A. The first bracket member bi-level base plate openings 24A are disposed in laterally extending rows 26A. The first bracket member bi-level base plate openings 24A and the second bracket member bi-level base plate openings 24B are positioned so that, when the first bracket member bi-level base plate 14A and the second bracket member bi-level base plate 14B are interleaved, as described above, the rows 26A of the first bracket member bi-level base plate openings 24A align with the rows 26B of the second bracket member bi-level base plate openings 24B. The first and second bi-level base plate openings 24A, 24B are positioned so that when the first and second members 12A, 12B are positioned to correspond to a predetermined mailbox 1 width, as described above, at least one pair of base plate openings 24A, 24B, i.e. one first bracket member bi-level base plate opening 24A and one second bracket member bi-level base plate opening 24B, are aligned.

More specifically, on the first bracket member 12A, at least two base plate opening rows 26A have three openings 24A', 24A", 24A'''. When the mailbox bracket assembly 10 is assembled, these at least two base plate opening rows 26A align with the corresponding at least two base plate opening rows 26B, having three openings 24B', 24B", 24B''' on the second bracket member 12B. In a first configuration, structured to correspond to a small width mailbox 1 as shown in FIG. 5, the distal opening 24A' (furthest from the lateral sidewall assembly 16A) on the first bracket member 12A is aligned with the proximal opening 24B''' (closest to the lateral sidewall assembly 16B) on the second bracket member 12B. Thus, the medial openings 24A", 24B" of the first and second bracket members 12A, 12B, respectively, are aligned. Finally, the first bracket member proximal opening 24A''' is aligned with the second bracket member distal opening 24B'. In this configuration, the mailbox bracket assembly 10 preferably has a width between about 5.5 inches and 7.0 inches, and more preferably about 6.0 inches.

In a second configuration, structured to correspond to a medium width mailbox 1' as shown in FIG. 6, the distal opening 24A' on the first bracket member 12A is aligned with the medial opening 24B" on the second bracket member 12B. Further, the medial opening 24A" on the first bracket member 12A is aligned with the distal opening 24B' on the second bracket member 12B. In this configuration, the mailbox bracket assembly 10 preferably has a width between about 7.0 inches and 9.0 inches, and more preferably about 8.0 inches.

In a third configuration, structured to correspond to a large width mailbox 1" as shown in FIG. 7, the distal opening 24A' on the first bracket member 12A is aligned with the distal opening 24B' on the second bracket member 12B. In this configuration, the mailbox bracket assembly 10 preferably has a width between about 9.0 inches and 11.0 inches, and more preferably about 10.0 inches. For mailboxes having a greater width than the maximum width of the mailbox bracket assembly 10, the mailbox bracket assembly 10 may further include at least one lateral extension 80. A lateral extension 80 is a spacer, preferably a tubular member 82 sized to accommodate a fastener. As shown in FIG. 8, the lateral extension 80 is disposed between the lateral sidewall assembly outer surface 44A, 44B, discussed below, and the depending portion of a mailbox sidewall.

It is noted that, following governmental deregulation, mailboxes may be manufactured is sizes other than the former standard sizes. For example, a new mailbox (not shown) may have a width of about seven inches, i.e. between a small and a medium mailbox 1. The mailbox bracket assembly 10 can be adapted to accommodate such intermediate sized mailboxes 1 by adjusting the lateral spacing between the base plate openings 24.

In any of the first, second or third configurations, the width of the mailbox bracket assembly 10 may be fixed by passing a fastener 30 or stud through one or more of the aligned openings 24A, 24B. Generally, these configurations may be described as occurring when the first bracket member bi-level base plate 14A and the second bracket member bi-level base plate 14B are fixed relative to each other at a selected lateral width by passing at least one fastener 30 through a set of aligned openings 24A, 24B in both the first bracket member bi-level base plate 14A and a second bracket member bi-level base plate 14B.

As noted above, the first bracket member 12A has a depending lateral sidewall assembly 16A. That is, the depending lateral sidewall assembly 16A depends from the first bracket member bi-level base plate outer lateral edge 23A of the first bracket member bi-level base plate 14A. The lateral sidewall assembly 16A includes a lateral member 40A extending substantially normal to the first bracket member bi-level base plate outer lateral edge 23A. The lateral sidewall assembly lateral member 40A has an inner surface 42A, which, with the exception of the optional offset portion 47A, 47B, discussed below, is generally planar and a generally planar outer surface 44A. While the lateral sidewall assembly 16A may be a solid member, and/or, the first bracket member bi-level base plate 14A may extend to the lateral sidewall assembly lateral member outer surface 44A, in the preferred embodiment, the lateral sidewall assembly lateral member inner surface 42A and the lateral sidewall assembly lateral member outer surface 44A are coupled by a web 46A. A web 46A is a plurality of spaced web members 48A that extend between the lateral sidewall assembly lateral member inner and outer surfaces 42A, 44A. As shown, the web members 48A include generally lateral web members 48A. The web members 48A may, however, be horizontal web members (not shown) which are disposed in a plane parallel to the first bracket member bi-level base plate 14A or angled web members (not shown) so long as the web members 48A are structured to separate the lateral sidewall assembly lateral member inner and outer surfaces 42A, 44A.

It is further noted that, during the manufacturing process, the at least one, and typically four, laterally extending braces 49A (described below) may be formed between the lateral sidewall assembly lateral member inner and outer surfaces 42A, 44A. As shown in FIGS. 1-7, the laterally extending braces 49A may remain positioned within the web. As shown in FIG. 8, the laterally extending braces 49A can be separated from the web and used as needed.

It is noted that a typical mailbox 1 includes a descending sidewall 2, or flange, that extends below the interior bottom panel of the mailbox 1. The descending sidewall 2 typically includes a number of spaced openings 3 for fasteners. The lateral sidewall assembly lateral member outer surface 44A includes a plurality of fastener openings 50A, which may be elongated longitudinally. Thus, during the coupling of the mailbox 1 to the mailbox bracket assembly 10, a user may simply insert the fasteners through the mailbox openings 3 into the lateral sidewall assembly lateral member outer surface fastener openings 50A. The lateral sidewall assembly lateral member outer surface fastener openings 50A may be large enough for the fastener to pass through freely, e.g. for a nut-and-bolt fastener, or may have a smaller diameter structured to allow the fastener to engage the material defining the opening, e.g. for a sheet metal screw.

Alternately, the mailbox 1 may be coupled to the mailbox bracket assembly 10 and/or support structure 4 by fasteners (not shown) extending generally vertically through the bottom plate of the mailbox 1. Such vertically extending fasteners pass through the mailbox bracket assembly 10, and more preferably through one or more of the bi-level base plate plurality of openings 24A, 24B, and then into the support structure 4.

A mailbox 1 and mailbox bracket assembly 10 are typically disposed on a vertical post 5, as shown in FIG. 2, or a horizontal arm 6, as shown in FIG. 1 or alternately in FIG. 8. The mailbox bracket assembly 10 is disposed between the mailbox 1 and the post 5 or arm 6. When the mailbox 1 is coupled to a horizontal arm 6, the mailbox bracket assembly 10 is, preferably, oriented as shown in FIGS. 3-5. That is, the first and second bracket members 12A, 12B are oriented so that the depending lateral sidewall assemblies 16A, 16B extend upwardly from the first and second members bi-level base plates 14A, 14B. This allows the generally flat lower surface of the interleaved first and second members bi-level base plates 14A, 14B to be coupled to the horizontal arm 6 by fasteners (not shown). Further, the mailbox 1 and mailbox bracket assembly 10 may be coupled to the outer surfaces of a hollow post 5, such as an extruded composite, or plastic, post 5. That is, the depending lateral sidewall assembly 16A may include a passage 52 therethrough. This passage is structured to allow a fastener to extend therethrough and into the vertical surface of the post 5.

When the mailbox 1 is coupled to a vertical post 5, the mailbox bracket assembly 10 is inverted relative to the orientation shown in FIGS. 3-5. That is, the first and second bracket members 12A, 12B are oriented so that the depending lateral sidewall assemblies 16A, 16B extend downwardly from the first and second members bi-level base plates 14A, 14B. Further, to assist in coupling the mailbox bracket assembly 10 to a generally square post, each of the first and second lateral sidewall assembly lateral member inner surface 42A, 42B may include an outwardly laterally offset portion 47A, 47B. That is, each lateral sidewall assembly lateral member inner surface laterally offset portion 47A, 47B is a planar portion of the lateral sidewall assembly lateral member inner surface 42A, 42B that is disposed in a plane parallel to the lateral sidewall assembly lateral member inner surface 42A, 42B, but offset toward to the lateral sidewall assembly lateral member outer surface 44A, 44B. The lateral member inner surface laterally offset portion 47A, 47B preferably extends along the associated bi-level base plate outer lateral edge 23A, 23B for a length approximately equal to the length of a common post for a mailbox 1. For example, in the United States a common post for a mailbox 1 is a "four-by-four" post, which in actual measurements is a generally square post having 3.5 inch sides.

As each of the first and second bracket members 12A, 12B has a lateral member inner surface laterally offset portion 47A, 47B, when the first and second bracket members 12A, 12B are assembled, the two lateral member inner surface laterally offset portions 47A, 47B define a pocket 60 for a mailbox post 5. Preferably, the pocket 60 is sized to correspond to the perimeter of a mailbox post 5 when the mailbox bracket assembly 10 is in the first, i.e. small width, configuration. When the mailbox bracket assembly 10 is in one of the wider configurations, the pocket 60 will be wider than a mailbox post 5. Spacers (not shown) may be used to fill the gap between the post 5 and pocket 60 in such a wide configuration. It is noted that the mailbox' can also be mounted through holes in the bottom of the mailbox' that correspond to the holes in the mailbox bracket assembly 10.

The first bracket member lateral member inner surface laterally offset portion 47A may further include at least one laterally extending brace 49A. The first bracket member lateral sidewall assembly lateral member inner surface at least one laterally extending brace 49A extends from one interface between the first bracket member lateral sidewall assembly lateral member inner surface 42A and the first bracket member lateral sidewall assembly lateral member inner surface laterally offset portion 47A. That is, the first bracket member lateral sidewall assembly lateral member inner surface at least one laterally extending brace 49A extends from a corner defined by the first bracket member lateral sidewall assembly lateral member inner surface laterally offset portion 47A. In this configuration, the first bracket member lateral sidewall assembly lateral member inner surface at least one laterally extending brace 49A is structured to further define the pocket 60.

Figure 9:
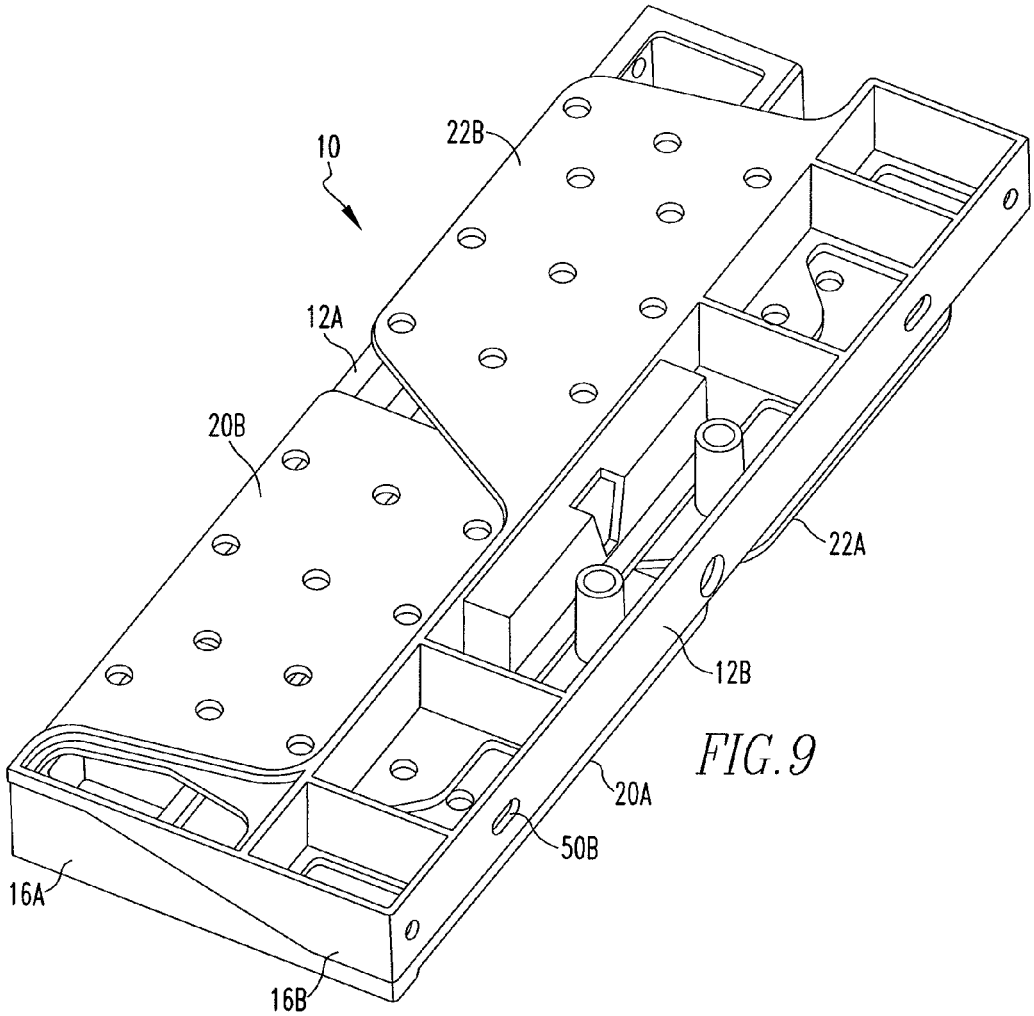
FIG. 9 is an isometric view of a mailbox bracket assembly members in a stacked, or packaged, configuration.

As described, the first bracket member 12A and the second bracket member 12B are substantially identical. It is noted that, by being substantially identical, only a single mold, or other production device, is needed to create both halves of the mailbox bracket assembly 10. Further, because the first and second bracket members 12A, 12B have a depending lateral sidewall assembly 16A, 16B extending from a single lateral edge, the first and second bracket members 12A, 12B have complimentary opposite shapes. That is, similar to a "yin-yang" pattern, the first bracket member 12A and the second bracket member 12B may be inverted and rotated 180 degrees about a vertical axis so as to be stacked on the other with the stacked first and second bracket members 12A, 12B having a lateral width corresponding to a single bracket member 12A, 12B, as shown in FIG. 9.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of invention which is to be given the full breadth of the claims appended and any and all equivalents thereof.

What is claimed is:

1. A mailbox bracket assembly comprising:

a first bracket member having a bi-level base plate and a depending lateral sidewall assembly;

a second bracket member having a bi-level base plate and a depending lateral sidewall assembly;

said first bracket member bi-level base plate and said second bracket member bi-level base plate structured to engage each other in an interleaved manner;

said first bracket member bi-level base plate has a first portion and a second portion;

said second bracket member bi-level base plate has a first portion and a second portion;

said first bracket member bi-level base plate first portion has a thickness and said first bracket member bi-level base plate second portion has a thickness;

said second bracket member bi-level base plate first portion has a thickness and said second bracket member bi-level base plate second portion has a thickness;

wherein said first bracket member bi-level base plate first portion thickness and said second bracket member bi-level base plate first portion thickness are substantially similar;

wherein said first bracket member bi-level base plate second portion thickness and said second bracket member bi-level base plate second portion thickness are substantially similar;

said first bracket member bi-level base plate first portion is structured to be interleaved with said second bracket member bi-level base plate second portion;

said first bracket member bi-level base plate second portion is structured to be interleaved with said second bracket member bi-level base plate first portion;

said first bracket member bi-level base plate first portion and said first bracket member bi-level base plate second portion each have a plurality of openings, said first bracket member bi-level base plate openings disposed in lateral rows;

said second bracket member bi-level base plate first portion and said second bracket member bi-level base plate second portion each have a plurality of openings, said second bracket member bi-level base plate openings disposed in lateral rows;

said first bracket member bi-level base plate openings and said second bracket member bi-level base plate openings positioned so that, when said first bracket member bi-level base plate and said second bracket member bi-level base plate are interleaved, said rows of said first bracket member bi-level base plate openings align with said rows of said second bracket member bi-level base plate openings;

whereby said first bracket member bi-level base plate and said second bracket member bi-level base plate may be fixed with at least one lateral width by passing at least one fastener through a set of aligned openings in both said first bracket member bi-level base plate and said second bracket member bi-level base plate.

2. The mailbox bracket assembly of claim 1 wherein:

said first bracket member bi-level base plate openings and said second bracket member bi-level base plate openings are spaced so that said first bracket member bi-level base plate and said second bracket member bi-level base plate may be fixed at one of three predetermined widths by passing at least one fastener through a set of aligned openings in both said first bracket member bi-level base plate and said second bracket member bi-level base plate.

3. The mailbox bracket assembly of claim 2 wherein said first bracket member and said second bracket member are substantially identical.

4. A mailbox bracket assembly comprising:

a first bracket member having a bi-level base plate and a depending lateral sidewall assembly;

a second bracket member having a bi-level base plate and a depending lateral sidewall assembly;

said first bracket member bi-level base plate and said second bracket member bi-level base plate structured to engage each other in an interleaved manner;

said first bracket member bi-level base plate has a first portion and a second portion;

said second bracket member bi-level base plate has a first portion and a second portion;

said first bracket member bi-level base plate first portion has a thickness and said first bracket member bi-level base plate second portion has a thickness;

said second bracket member bi-level base plate first portion has a thickness and said second bracket member bi-level base plate second portion has a thickness;

wherein said first bracket member bi-level base plate first portion thickness and said second bracket member bi-level base plate first portion thickness are substantially similar;

wherein said first bracket member bi-level base plate second portion thickness and said second bracket member bi-level base plate second portion thickness are substantially similar;

said first bracket member lateral sidewall assembly includes a lateral member extending substantially normal to said first bracket member bi-level base plate, said first bracket member lateral sidewall assembly lateral member having an inner surface, disposed adjacent to said first bracket member bi-level base plate, and an outer surface;

said second bracket member lateral sidewall assembly includes a lateral member extending substantially normal to said second bracket member bi-level base plate, said second bracket member lateral sidewall assembly lateral member having an inner surface, disposed adjacent to said second bracket member bi-level base plate, and an outer surface;

said first bracket member lateral sidewall assembly lateral member outer surface includes a plurality of fastener openings; and said second bracket member lateral sidewall assembly lateral member outer surface includes a plurality of fastener openings.

5. A mailbox bracket assembly comprising:

a first bracket member having a bi-level base plate and a depending lateral sidewall assembly;

a second bracket member having a bi-level base plate and a depending lateral sidewall assembly;

said first bracket member bi-level base plate and said second bracket member bi-level base plate structured to engage each other in an interleaved manner;

said first bracket member bi-level base plate has a first portion and a second portion;

said second bracket member bi-level base plate has a first portion and a second portion;

said first bracket member bi-level base plate first portion has a thickness and said first bracket member bi-level base plate second portion has a thickness;

said second bracket member bi-level base plate first portion has a thickness and said second bracket member bi-level base plate second portion has a thickness;

wherein said first bracket member bi-level base plate first portion thickness and said second bracket member bi-level base plate first portion thickness are substantially similar;

wherein said first bracket member bi-level base plate second portion thickness and said second bracket member bi-level base plate second portion thickness are substantially similar;

said first bracket member lateral sidewall assembly includes a lateral member extending substantially normal to said first bracket member bi-level base plate, said first bracket member lateral sidewall assembly lateral member having an inner surface, disposed adjacent to said first bracket member bi-level base plate, and an outer surface;

said second bracket member lateral sidewall assembly includes a lateral member extending substantially normal to said second bracket member bi-level base plate, said second bracket member lateral sidewall assembly lateral member having an inner surface, disposed adjacent to said second bracket member bi-level base plate, and an outer surface;

said first bracket member lateral sidewall assembly lateral member inner surface coupled to said first bracket member lateral sidewall assembly lateral member outer surface by a web;

said second bracket member lateral sidewall assembly lateral member inner surface coupled to said second bracket member lateral sidewall assembly lateral member outer surface by a web;

said first bracket member lateral sidewall assembly includes at least one lateral extension, said first bracket member lateral sidewall assembly lateral extension being a tubular member, said first bracket member lateral sidewall assembly lateral extension structured to be coupled to said first bracket member lateral sidewall assembly lateral member outer surface at a fastener opening; and said second bracket member lateral sidewall assembly includes at least one lateral extension, said second bracket member lateral sidewall assembly lateral extension being a tubular member, said second bracket member lateral sidewall assembly lateral extension structured to be coupled to said second bracket member lateral sidewall assembly lateral member outer surface at a fastener opening.

6. The mailbox bracket assembly of claim 5 wherein:

said first bracket member bi-level base plate first portion and said first bracket member bi-level base plate second portion each have a plurality of openings, said first bracket member bi-level base plate openings disposed in lateral rows;

said second bracket member bi-level base plate first portion and said second bracket member bi-level base plate second portion each have a plurality of openings, said second bracket member bi-level base plate openings disposed in lateral rows;

said first bracket member bi-level base plate openings and said second bracket member bi-level base plate openings positioned so that, when said first bracket member bi-level base plate and said second bracket member bi-level base plate are interleaved, said rows of said first bracket member bi-level base plate openings align with said rows of said second bracket member bi-level base plate openings; and whereby said first bracket member bi-level base plate and said second bracket member bi-level base plate may be fixed with at least one lateral width by passing at least one fastener through a set of aligned openings in both said first bracket member bi-level base plate and said second bracket member bi-level base plate.

7. The mailbox bracket assembly of claim 6 wherein:

said first bracket member bi-level base plate openings and said second bracket member bi-level base plate openings are spaced so that said first bracket member bi-level base plate and said second bracket member bi-level base plate may be fixed at one of four predetermined widths by passing at least one fastener through a set of aligned openings in both said first bracket member bi-level base plate and said second bracket member bi-level base plate.

8. A mailbox bracket assembly comprising:

a first bracket member having a bi-level base plate and a depending lateral sidewall assembly;

a second bracket member having a bi-level base plate and a depending lateral sidewall assembly;

said first bracket member bi-level base plate and said second bracket member bi-level base plate structured to engage each other in an interleaved manner;

said first bracket member bi-level base plate has a first portion and a second portion;

said second bracket member bi-level base plate has a first portion and a second portion;

said first bracket member bi-level base plate first portion has a thickness and said first bracket member bi-level base plate second portion has a thickness;

said second bracket member bi-level base plate first portion has a thickness and said second bracket member bi-level base plate second portion has a thickness;

wherein said first bracket member bi-level base plate first portion thickness and said second bracket member bi-level base plate first portion thickness are substantially similar;

wherein said first bracket member bi-level base plate second portion thickness and said second bracket member bi-level base plate second portion thickness are substantially similar;

said first bracket member lateral sidewall assembly includes a lateral member extending substantially normal to said first bracket member bi-level base plate, said first bracket member lateral sidewall assembly lateral member having an inner surface, disposed adjacent to said first bracket member bi-level base plate, and an outer surface;

said second bracket member lateral sidewall assembly includes a lateral member extending substantially normal to said second bracket member bi-level base plate, said second bracket member lateral sidewall assembly lateral member having an inner surface, disposed adjacent to said second bracket member bi-level base plate, and an outer surface;

said first bracket member lateral sidewall assembly lateral member inner surface includes an outwardly laterally offset portion;

said second bracket member lateral sidewall assembly lateral member inner surface includes an outwardly laterally offset portion;

said first bracket member lateral sidewall assembly lateral member inner surface laterally offset portion is sized to accommodate a four-by-four post; and said second bracket member lateral sidewall assembly lateral member inner surface laterally offset portion is sized to accommodate a four-by-four post.

9. A mailbox bracket assembly comprising:

a first bracket member having a bi-level base plate and a depending lateral sidewall assembly;

a second bracket member having a bi-level base plate and a depending lateral sidewall assembly;

said first bracket member bi-level base plate and said second bracket member bi-level base plate structured to engage each other in an interleaved manner;

said first bracket member bi-level base plate has a first portion and a second portion;

said second bracket member bi-level base plate has a first portion and a second portion;

said first bracket member bi-level base plate first portion has a thickness and said first bracket member bi-level base plate second portion has a thickness;

said second bracket member bi-level base plate first portion has a thickness and said second bracket member bi-level base plate second portion has a thickness;

wherein said first bracket member bi-level base plate first portion thickness and said second bracket member bi-level base plate first portion thickness are substantially similar;

wherein said first bracket member bi-level base plate second portion thickness and said second bracket member bi-level base plate second portion thickness are substantially similar;

said first bracket member lateral sidewall assembly includes a lateral member extending substantially normal to said first bracket member bi-level base plate, said first bracket member lateral sidewall assembly lateral member having an inner surface, disposed adjacent to said first bracket member bi-level base plate, and an outer surface;

said second bracket member lateral sidewall assembly includes a lateral member extending substantially normal to said second bracket member bi-level base plate, said second bracket member lateral sidewall assembly lateral member having an inner surface disposed adjacent to said second bracket member bi-level base plate, and an outer surface;

said first bracket member lateral sidewall assembly lateral member inner surface includes an outwardly laterally offset portion;

said second bracket member lateral sidewall assembly lateral member inner surface includes an outwardly laterally offset portion;

said first bracket member lateral sidewall assembly lateral member inner surface includes at least one laterally extending brace;

said first bracket member lateral sidewall assembly lateral member inner surface at least one laterally extending brace extending from one interface between said first bracket member lateral sidewall assembly lateral member inner surface and said first bracket member lateral sidewall assembly lateral member inner surface laterally offset portion;

said second bracket member lateral sidewall assembly lateral member inner surface includes at least one laterally extending brace; and said second bracket member lateral sidewall assembly lateral member inner surface at least one laterally extending brace extending from one interface between said second bracket member lateral sidewall assembly lateral member inner surface and said second bracket member lateral sidewall assembly lateral member inner surface laterally offset portion.

10. A mailbox bracket assembly comprising:

a first bracket member having a bi-level base plate and a depending lateral sidewall assembly;

a second bracket member having a bi-level base plate and a depending lateral sidewall assembly;

said first bracket member bi-level base plate and said second bracket member bi-level base plate structured to engage each other in an interleaved manner;

said first bracket member bi-level base plate has a first portion and a second portion;

said second bracket member bi-level base plate has a first portion and a second portion;

said first bracket member bi-level base plate first portion has a thickness and said first bracket member bi-level base plate second portion has a thickness;

said second bracket member bi-level base plate first portion has a thickness and said second bracket member bi-level base plate second portion has a thickness;

wherein said first bracket member bi-level base plate first portion thickness and said second bracket member bi-level base plate first portion thickness are substantially similar;

wherein said first bracket member bi-level base plate second portion thickness and said second bracket member bi-level base plate second portion thickness are substantially similar;

said first bracket member lateral sidewall assembly includes a lateral member extending substantially normal to said first bracket member bi-level base plate, said first bracket member lateral sidewall assembly lateral member having an inner surface, disposed adjacent to said first bracket member bi-level base plate, and an outer surface;

said second bracket member lateral sidewall assembly includes a lateral member extending substantially normal to said second bracket member bi-level base plate, said second bracket member lateral sidewall assembly lateral member having an inner surface, disposed adjacent to said second bracket member bi-level base plate, and an outer surface;

said first bracket member lateral sidewall assembly lateral member inner surface includes at least one laterally extending brace; and said second bracket member lateral sidewall assembly lateral member inner surface includes at least one laterally extending brace.

11. The mailbox bracket assembly of claim 10 wherein said first bracket member and said second bracket member are substantially identical.

12. A mailbox bracket assembly comprising:

a first bracket member having a bi-level base plate and a depending lateral sidewall assembly;

a second bracket member having a bi-level base plate and a depending lateral sidewall assembly;

said first bracket member bi-level base plate and said second bracket member bi-level base plate structured to engage each other in an interleaved manner;

said first bracket member and said second bracket member are substantially identical; and wherein one of said first bracket member and said second bracket member may be inverted and rotated so as to be stacked on the other with the stacked first and second bracket members have a lateral width corresponding to a single bracket member.

* * * * *